US006585259B2

(12) United States Patent
Kerpe et al.

(10) Patent No.: US 6,585,259 B2
(45) Date of Patent: Jul. 1, 2003

(54) DELIVERY OF A MACHINE FOR PROCESSING FLAT PRINTING MATERIALS

(75) Inventors: Sven Kerpe, Eggenstein-Leopoldshafen (DE); Frank Gunschera, Nussloch (DE); Christian Hieb, Neuhofen (DE); Markus Gerstenberger, Heidelberg (DE); Peter Hachmann, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 167 days.

(21) Appl. No.: 09/740,652

(22) Filed: Dec. 18, 2000

(65) Prior Publication Data

US 2001/0008327 A1 Jul. 19, 2001

(30) Foreign Application Priority Data

Dec. 17, 1999 (DE) ..... 199 61 368
Sep. 6, 2000 (DE) ..... 100 43 807

(51) Int. Cl.[7] ..... B41F 23/04
(52) U.S. Cl. ..... 271/195; 101/424.1; 406/88
(58) Field of Search ..... 271/195, 193, 271/11, 34; 101/216, 424, 732; 406/88; 270/1.01

(56) References Cited

U.S. PATENT DOCUMENTS 5,655,449 A 8/1997 Henn et al.
5,687,964 A 11/1997 Stephan et al.
5,797,327 A * 8/1998 Gieser et al. ..... 271/195 X
5,803,448 A * 9/1998 Stiel et al. ..... 271/195 X

FOREIGN PATENT DOCUMENTS

| | | | | |
|---|---|---|---|---|
| DE | 1 449 656 | | 6/1972 | |
| DE | 44 06 846 C1 | | 5/1995 | |
| DE | 44 27 448 A1 | | 2/1996 | |
| DE | 195 24 641 A1 | | 3/1996 | |
| DE | 195 45 799 C1 | | 1/1997 | |
| JP | 405124746 | * | 5/1993 | ..... 271/194 |

* cited by examiner

*Primary Examiner*—Janice L. Krizek
(74) *Attorney, Agent, or Firm*—Laurence A. Greenberg; Werner H. Stemer; Gregory L. Mayback

(57) ABSTRACT

A delivery of a machine for processing flat printing materials, having a sheet guide surface over which the sheets are drawn during operation, with forcible guidance of an edge of the sheets extending in a processing direction, respectively, includes nozzles opening into the sheet guide surface and providing flow therethrough during operation, and a blown air curtain, formed during operation, which extends over the sheet guide surface transversely with respect to the processing direction and is aimed at a target region on the sheet guide surface. The nozzles are arranged on the sheet guide surface in accordance with a first mode and a second mode, the nozzles arranged in accordance with a first of the modes outputting during operation a flow which counteracts a volume flow, from the blown air curtain, which is deflected downline with respect to the processing direction.

6 Claims, 4 Drawing Sheets

DELIVERY OF A MACHINE FOR PROCESSING FLAT PRINTING MATERIALS

BACKGROUND OF THE INVENTION

Field of the Invention

The invention relates to a delivery of a machine for processing flat printing materials, in particular, a sheet-processing rotary printing machine, having a sheet guide surface over which the sheets are drawn during operation, with forcible guidance of an edge of the sheets that extends in a processing direction, respectively, having nozzles which open into the sheet guide surface and through which flow occurs during operation, and having a blown air curtain, formed during operation, which extends over the sheet guide surface transversely to the processing direction and is aimed at a target region on the sheet guide surface; and to a machine for processing flat printing materials, which is equipped with the delivery.

A delivery of the aforementioned type is disclosed, for example, in the published German Patent Document DE 195 24 641 A1. The blown or blast air curtains disclosed therein and outputted by dryers, and the nozzles opening into the sheet guide surface, form a configuration such that the target region of a respective blown air curtain is provided with a row of nozzles, these nozzles producing a flow which is oriented in the processing direction.

This mutual association of nozzles and blown air curtains is used to counteract the effect which otherwise occurs that a corresponding blown air curtain forces the sheet passing the latter in the area of the target region in a direction towards the sheet guide surface as long as the sheet covers the target region.

SUMMARY OF THE INVENTION

It is accordingly an object of the invention to provide a delivery of a machine for processing flat printing materials which is of such construction that the risk of having the trailing end of a respective sheet turn up as it leaves the target region is counteracted.

With the foregoing and other objects in view, there is provided, in accordance with one aspect of the invention, a delivery of a machine for processing flat printing materials, having a sheet guide surface over which the sheets are drawn during operation, with forcible guidance of an edge of the sheets extending in a processing direction, respectively, comprising nozzles opening into the sheet guide surface and providing flow therethrough during operation, and a blown air curtain, formed during operation, which extends over the sheet guide surface transversely with respect to the processing direction and is aimed at a target region on the sheet guide surface, the nozzles being arranged on the sheet guide surface in accordance with a first mode and a second mode, the nozzles arranged in accordance with a first of the modes outputting during operation a flow which counteracts a volume flow, from the blown air curtain, which is deflected downline with respect to the processing direction.

In accordance with another feature of the invention, the nozzles arranged in accordance with the first mode are located within a strip of the sheet guide surface extending transversely to the processing direction and form a grid the extent of which transverse to the processing direction is matched to the corresponding extent of the maximum format of the sheets which can be processed.

In accordance with a further feature of the invention, the nozzles arranged in accordance with the first mode output blown air jets directed counter to the processing direction.

In accordance with an added feature of the invention, the nozzles arranged in accordance with a second of the modes are subdivided into two groups by an imaginary center line extending in the processing direction and bisecting the sheet guide surface, and the nozzles of a respective one of the two groups output flows during operation which are directed away from the imaginary center line.

In accordance with an additional feature of the invention, the nozzles arranged in accordance with the first and the second mode differ in the distribution thereof on the sheet guide surface, and the nozzles located on a respective side of the imaginary center line output flows during operation which are directed identically to one another.

In accordance with yet another feature of the invention, the nozzles arranged in accordance with the first mode are associated with a blown air supply, which supplies these nozzles independently of the nozzles arranged in accordance with the second mode.

In accordance with a concomitant aspect of the invention, there is provided a machine for processing flat printing materials, having a delivery provided with a sheet guide surface over which sheets are drawn during operation, with forcible guidance of an edge of the sheets extending in a processing direction, respectively, comprising nozzles opening into the sheet guide surface and providing flow therethrough during operation, and a blown air curtain, formed during operation, which extends over the sheet guide surface transversely with respect to the processing direction and is aimed at a target region on the sheet guide surface, the nozzles being arranged on the sheet guide surface in accordance with a first mode and in accordance with a second mode, the nozzles arranged in accordance with a first of the modes outputting during operation a flow which counteracts a volume flow, from the blown air curtain, which is deflected downline with respect to the processing direction.

In order to achieve the aforestated object of the invention, the delivery is configured to the effect that the nozzles are arranged on the sheet guide surface in accordance with a first and a second mode, the nozzles arranged in accordance with a first of the modes outputting during operation a flow which counteracts a volume flow, from the blown air curtain, which is deflected downline with respect to the processing direction.

The target region which is located on the sheet guide surface and at which the blown air curtain is aimed is then acted upon by the latter with blown air, respectively, when a trailing end portion of the respective sheet no longer covers the target region and a leading end portion of a following sheet or a gripper system forwarding the following sheet does not yet cover the target region. During this time interval, given a conventional configuration of the delivery mentioned at the at the introduction hereto, and the equipment of the latter with a blown air curtain in the form of a dryer outputting hot-air doctors, in particular a part of the blown air curtain deflected downline by the sheet guide surface becomes effective so that it blows under the trailing portion of a respective sheet and causes this end portion to turn up. This results in a very detrimental influence on the sheet run, which has multiple effects, inasmuch as it can lead to lubrication problems and to problems when gripping the sheets by a subsequent sheet brake. In order to counter these problems, it was necessary to operate with low dryer outputs, i.e., with a low volume flow and a low flow velocity of the hot-air doctor, but this necessitated a relatively low processing speed in the case of a correspondingly insufficient drying result, and a great deal of effort was necessary in order to set the parameters influencing the air cushion in order to guide the sheets so as to float.

All these problems are eliminated by the invention in a surprisingly simple way in that a blown air curtain output by a dryer is prevented from blowing underneath the trailing end portion of a respective sheet, specifically as a result of the fact that, in the aforementioned target region, a volume flow of the blown air curtain which is deflected downline is counteracted by a flow.

Although the invention is illustrated and described herein as embodied in a delivery of a machine processing flat printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
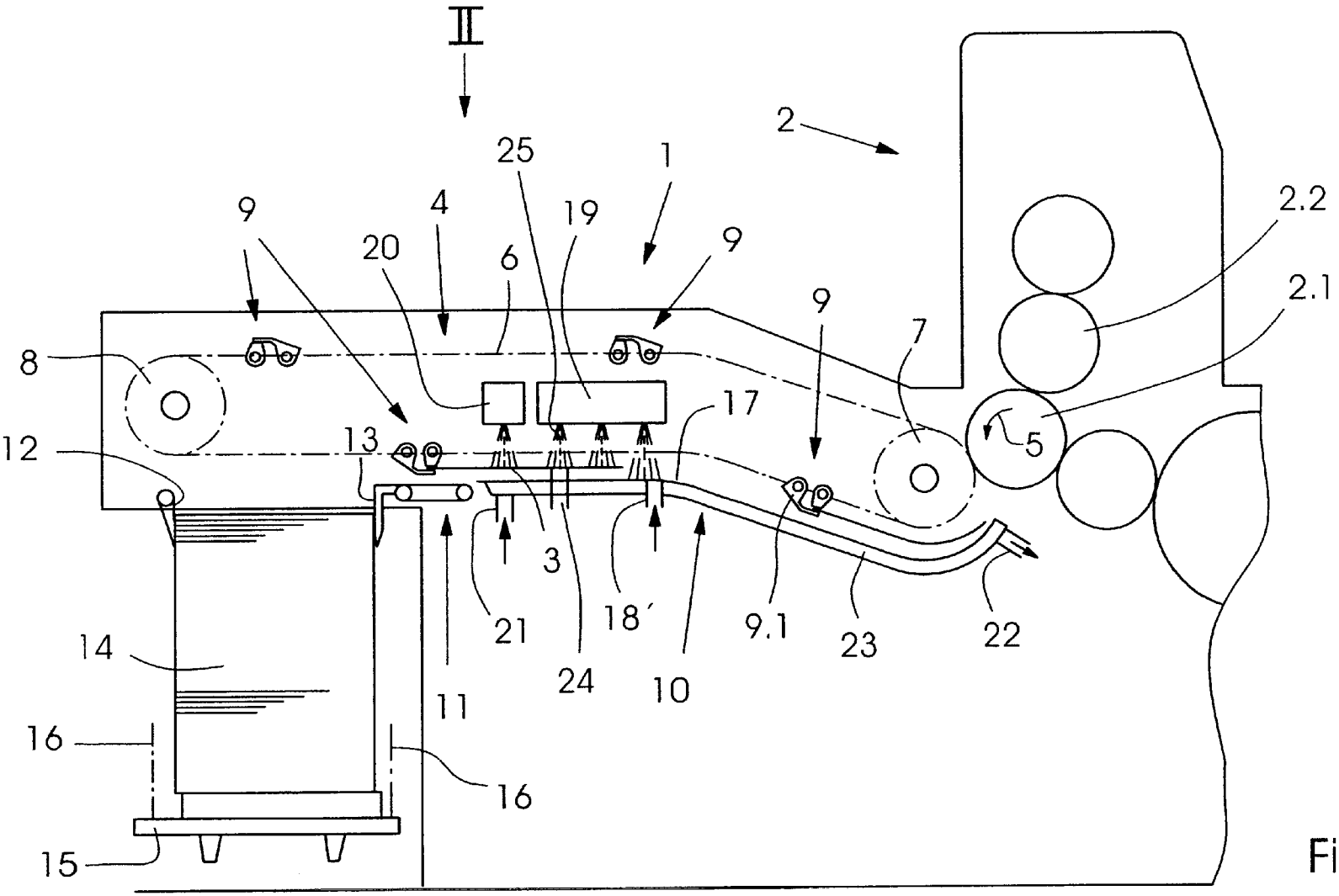
FIG. 1 is a fragmentary diagrammatic side elevational view of a printing machine including a delivery having a sheet guide surface which, in a manner not shown here, is provided with a nozzle arrangement according to the invention.

Referring now to the drawings and, first, particularly to FIG. 1 thereof, there is shown therein part of a sheet-processing rotary printing machine including a delivery 1 following after a last processing station. Such a processing station may be a printing unit or a post-treatment unit, such as a varnishing unit. In the example at hand, the last processing station is a printing unit 2 operating in the offset process and having an impression cylinder 2.1 which guides a respective sheet 3, in a processing direction indicated by a direction-of-rotation arrow 5, through a printing nip between the impression cylinder 2.1 and a blanket cylinder 2.2 cooperating therewith, and subsequently transfers it to a chain conveyor 4 while opening grippers which are arranged on the impression cylinder 2.1 and are provided to grip the sheets 3 at a gripper edge at the leading end of the sheet. The chain conveyor 4 includes two conveyor chains 6, of which one respective chain runs along a respective side wall of the chain delivery 1 during operation. A respective conveyor chain 6 loops around each of two synchronously driven drive sprockets 7, which have axes of rotation that are aligned with one another and, in this example, the chain is guided over a return or reversing sprocket 8, respectively, located opposite the drive sprockets 7 and downline with respect to the processing direction. Between the two conveyor chains 6 there extend gripper systems 9 which are borne by the latter and have grippers 9.1, which pass through gaps formed between the grippers arranged on the impression cylinder 2.1 and, in the process, accept a respective sheet 3 by gripping the aforementioned gripper edge at the leading end of the sheet 3 directly before the grippers arranged on the impression cylinder 2.1 open, transport the sheet over a sheet guide device 18 to a sheet brake 11 and open thereat in order to transfer the sheet 3 to the sheet brake 11. The latter imparts to the sheets a depositing speed which is reduced with respect to the processing speed and, after reaching the depositing speed, in turn, releases the sheets, so that a respective, now retarded sheet 3, finally impacts leading edge stops 12 and, being aligned against the latter and against trailing edge stops 13 located opposite these, together with preceding and/or following sheets 3, forms a sheet pile 14, which can be lowered by a lifting mechanism to the extent to which the sheet pile 14 grows. Of the lifting mechanism, FIG. 1 reproduces only a platform 15 carrying the pile 14, and lifting chains 16 which carry the platform 15 and are indicated in phantom or by dot-dash lines.

Along the path thereof between the drive sprockets 7, on the one hand, and the return sprockets 8, on the other hand, the conveyor chains 6 are guided by chain guide rails, which therefore determine the chain paths of the chain strands. In this example, the sheets 3 are transported by the lower chain strand in FIG. 1. The portion of the chain path through which the latter passes is followed alongside by a sheet guide surface 17 which faces that portion and is formed on the sheet guide device 10. Between the surface and the respective sheet 3 over it, a carrying air cushion is preferably formed during operation. To this end, the sheet guide device 10 is equipped with nozzles 18 which are not illustrated in FIG. 1, but open into the sheet guide surface 17 (note FIG. 2), to supply which a connecting piece 18' is shown reproduced in a symbolic illustration.

In order to prevent mutual sticking of the printed sheets 3 in the pile 14, a dryer 19 and a powdering device 20 are provided on the path of the sheets 3 from the drive sprockets 7 to the sheet brake 11.

In order to prevent excessive heating of the sheet guide surface 17 by the dryer 19, a coolant circuit is integrated into the sheet guide device 10 and is indicated symbolically in FIG. 1 by an inlet connecting piece 21 and an outlet connecting piece 22 on a coolant trough 23 associated with the sheet guide surface 17.

In the delivery 1, during operation, there is a blown or blast air curtain 25 which extends transversely with respect to the processing direction and is aimed at a target region 24 on the sheet guide surface 17, the curtain having, in particular, the form of a hot-air doctor output by the dryer 19.

Figure 2:
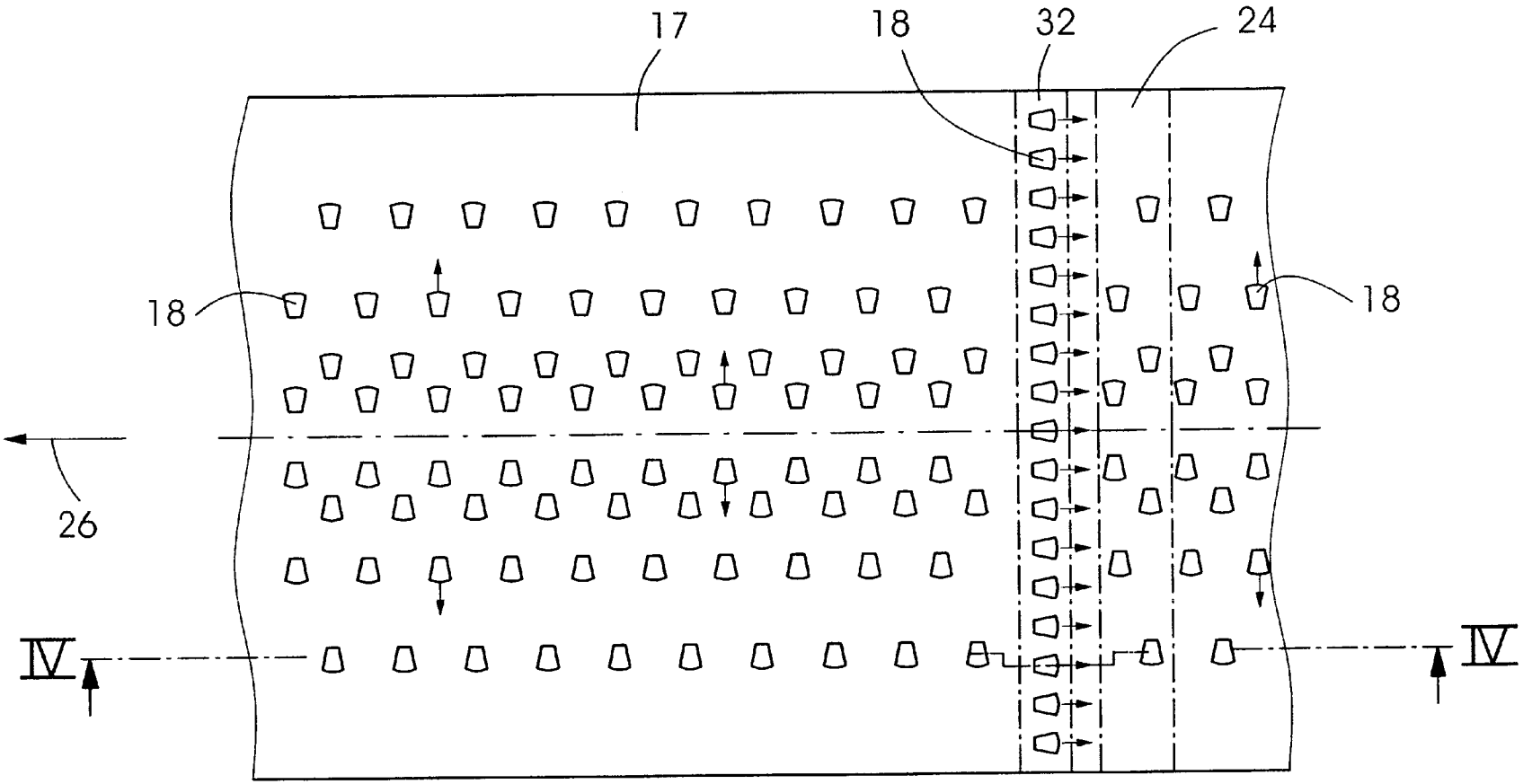
FIG. 2 is a fragmentary plan view of the sheet guide surface, as viewed in the direction of the arrow II in FIG. 1, with an arrangement of the nozzles provided in accordance with a first embodiment and according to a first and a second mode.

FIG. 2 reproduces a first configuration of a portion of the sheet guide surface 17 formed by a guide plate, as viewed in the direction of the arrow II in FIG. 1. The area of the sheet guide surface 17 which is located between dot-dash lines represents the target region 24, at which the blown air curtain 25 is aimed. The nozzles opening into the sheet guide surface 17 form a first embodiment or variant of the arrangement thereof on the sheet guide surface 17, nozzles 18 arranged in accordance with a first of the two modes forming a row 27 of nozzles which is located downline with respect to the target region 24, as referred to the processing direction indicated by the directional arrow 26, the row extending transversely to the processing direction, and the nozzles 18 thereof being oriented so that when there is flow therethrough during operation, they produce a flow which is directed upline between the sheet guide surface 17 and the respective sheet 3, while in the embodiment or variant shown here, the nozzles arranged in accordance with a second of the two modes are subdivided into two groups by an imaginary center line that runs in the processing direction and bisects the sheet guide surface 17, and the nozzles 18 of a respective one of the two groups output flows during operation which are directed away from the imaginary center line. According to the exemplary embodiment reproduced in FIG. 2, these flows are aimed perpendicularly at the lateral edges of the sheet guide surface 17.

While the flow during operation through the nozzles arranged in accordance with the second mode forms the aforementioned carrying air cushion, the flow output from the row 27 of nozzles is aimed at a part of the blown air curtain 25 which is deflected downline and, for its part, deflects this deflected part in such a direction that a flow from the blown air curtain which prevails thereat does not blow under a respective sheet 3 leaving the target region 24.

If, as indicated in FIG. 1, the blown air curtain 25 is composed of a number of partial curtains which extend transversely with respect to the processing direction and follow one another in the processing direction, then if the part curtains are sufficiently closely adjacent, a partial curtain which, respectively, is downline from an adjacent partial curtain prevents the trailing end of a respective sheet 3 from turning up when the latter leaves the area of influence of the adjacent partial curtain upline.

The arrangement of the nozzles 18 which form the row 27 of nozzles, which is provided in such a way, according to the first configuration of FIG. 2, that these nozzles output flows during operation which are oriented counter to the processing direction, in accordance with the directional arrow 26, is recommended in particular when processing relatively stiff printing materials.

Figure 3:
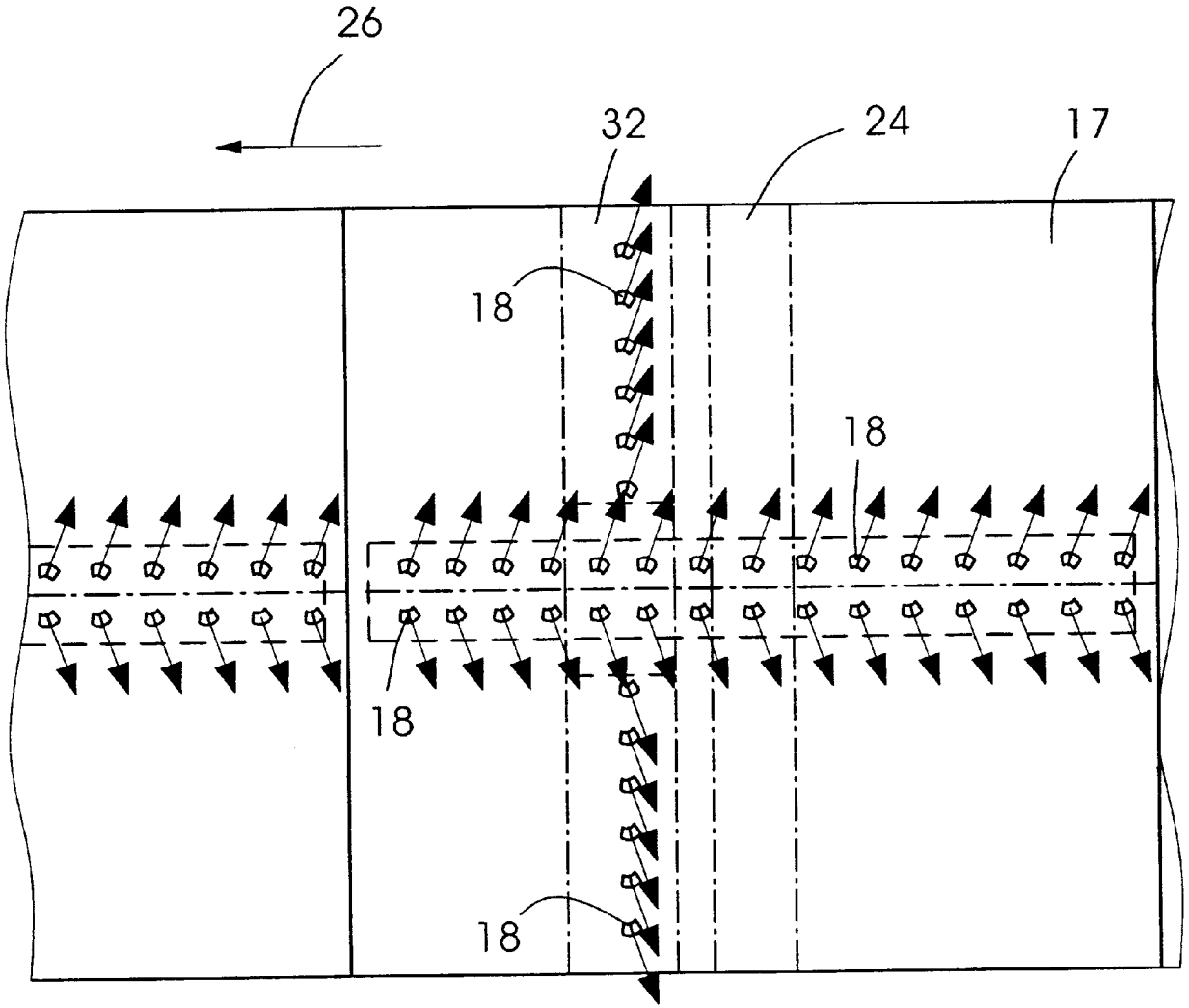
FIG. 3 is a fragmentary plan view of the sheet guide surface, corresponding to the illustration of FIG. 2, with an arrangement of the nozzles provided in accordance with a second embodiment and according to a first and a second mode.

A second configuration, reproduced in FIG. 3, is recommended in particular for processing relatively flexible printing materials, but is also suitable for processing printing materials with quite different flexibilities and grammages. In the case of this configuration, the nozzles 18 arranged in accordance with the first mode, just as in the first configuration, are located within a strip 32 of the sheet guide surface 17 which extends transversely with respect to the processing direction according to directional arrow 26, and is downline with respect to the target region 24, and, just as in the case of the first configuration according to FIG. 2, they form a grid the extent of which transverse to the processing direction is matched to the corresponding extent of the maximum format of the sheets 3 which can be processed.

In the case of the second configuration, the nozzles 18 arranged in accordance with the first and the second mode on a respective side of the aforementioned center line do not differ in terms of their alignment, as is the case in the configuration according to FIG. 2, instead a difference between the two arrangement modes lies in the distribution of the nozzles 18 over the sheet guide surface 17, according to which, in the case of the configuration according to FIG. 3, the nozzles 18 arranged in accordance with the second mode are restricted at least to one area of the sheet guide surface 17, which extend transversely to the processing direction within a corresponding extent of the sheets having the smallest format which can be processed.

However, the identical arrangement on a respective side of the imaginary center line of the nozzles 18 arranged in accordance with the two modes, i.e., the output thereof during operation of flows which are each directed identically, results in none of these flows crossing, which has an advantageous effect, in particular in the case of relatively flexible sheets with a relatively low grammage, in that local distortions of the sheets, which can occur at corresponding crossing points in the case of mutually crossing flows, are prevented.

Figure 4:
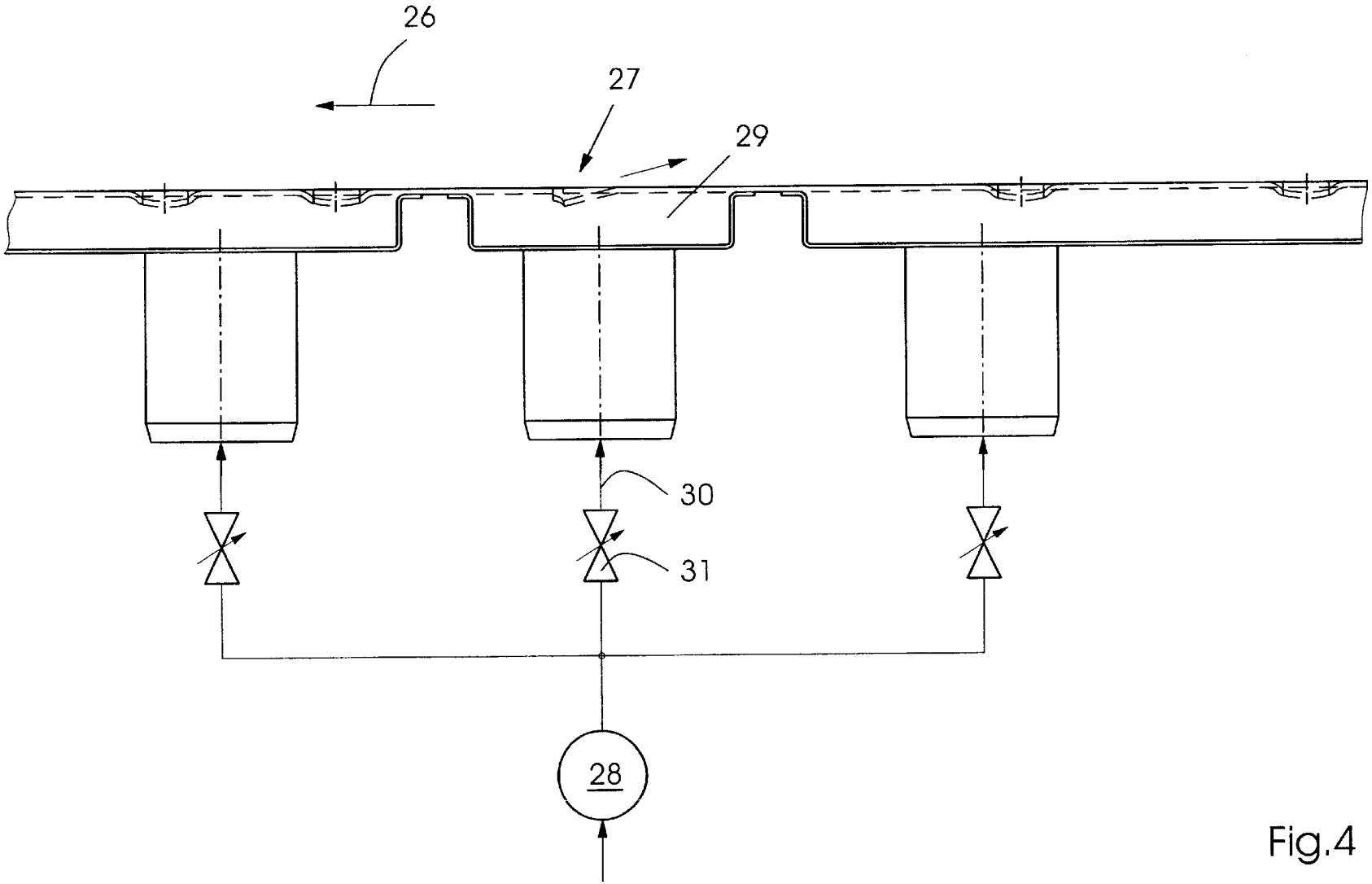
FIG. 4 is a sectional view of FIG. 2 taken along the line IV—IV in the direction of the arrows, and showing an exemplary embodiment of a sheet guide device according to the invention.

FIG. 4 reproduces an exemplary embodiment of an individual blown air connection of the nozzles 18 according to FIG. 2 which are arranged in accordance with the first mode and, in the case shown, form the row 27 of nozzles. In this case, air provided under pressure in a tank 28 is fed to a blower box 29, which supplies the row 27 of nozzles, via a supply line 30, into which a controllable valve 31 is inserted.

We claim:

1. A machine for processing sheets in a processing direction, comprising:

a delivery;

a sheet guide surface having a given width;

a conveyor for pulling the sheets over said sheet guide surface;

nozzles opening into said sheet guide surface;

a blown air supply for communicating with said nozzles;

a blower disposed above said sheet guide surface to form a blown air curtain extending over said sheet guide surface transversely with respect to the processing direction, aimed at a target region on said sheet guide surface, and resulting in deflection of at least one part of flow, by said sheet guide surface, downline with reference to the processing direction; and said nozzles forming a first and a second group of nozzles, said first group being arranged on said sheet guide surface in accordance with a first mode and said second group being arranged on said sheet guide surface in accordance with a second mode, said nozzles of said first group outputting during operation a flow counteracting said deflected part of flow.

2. The machine according to claim 1, wherein said first group of nozzles is located within a strip-shaped area of said sheet guide surface extending transversely to the processing direction and forming a grid having an extent matched to said width of said sheet guide surface.

3. The machine according to claim 1, wherein said nozzles of said first group output blown air jets directed counter to the processing direction.

4. The machine according to claim 1, wherein said second group of nozzles is subdivided into two sub-groups by an imaginary center line extending in the processing direction and bisecting said sheet guide surface, and said nozzles of a respective one of the two sub-groups output flows during operation which are directed away from the imaginary center line.

5. The machine according to claim 1, wherein said nozzles of said first group and said second group differ in the distribution thereof on said sheet guide surface, said nozzles of both groups are located on a respective side of an imaginary center line extending in the processing direction and bisecting said sheet guide surface, and said nozzles located on a respective side of the imaginary center line output flows during operation which are directed identically to one another.

6. The machine according to claim 1, wherein said blown air supply is adapted to supply said nozzles of said first group independently of said nozzles of said second group.

* * * * *